United States Patent [19]

Akamatsu

[11] Patent Number: 4,777,665

[45] Date of Patent: Oct. 18, 1988

[54] QUICK-RELEASE NECKTIE

[75] Inventor: Shigeru Akamatsu, Ikeda, Japan

[73] Assignee: Osaka Necktie Hosei Kabushiki Kaisha, Osaka, Japan

[21] Appl. No.: 69,469

[22] Filed: Jul. 2, 1987

[30] Foreign Application Priority Data

Jul. 7, 1986 [JP] Japan ..... 61-104096[U]
Mar. 9, 1987 [JP] Japan ..... 62-34686[U]

[51] Int. Cl.[4] ..... A41D 25/16
[52] U.S. Cl. ..... 2/155; 2/156
[58] Field of Search ..... 2/155, 156

[56] References Cited

U.S. PATENT DOCUMENTS

| | | | |
|---|---|---|---|
| 1,422,758 | 7/1922 | Goldberg | 2/155 |
| 1,431,268 | 10/1922 | Spiegler | 2/155 X |
| 1,581,845 | 4/1926 | Loth | 2/155 |
| 1,957,141 | 5/1934 | Jordan | 2/155 X |
| 3,872,513 | 3/1975 | Beaudin et al. | 2/155 |

*Primary Examiner*—Louis K. Rimrodt
*Attorney, Agent, or Firm*—Flynn, Thiel, Boutell & Tanis

[57] ABSTRACT

A quick-release necktie comprising a preliminarily tied necktie base having a knot, neckbands extending of both sides of the knot and a pair of quick-releasable male and female fastening means attached to the ends of the neckbands. The male fastening means is formed of a tongue-like plug portion having wedge-form, captively engaging projections on both faces. The female fastening means is formed of a socket portion including a pair of juxtaposed plate-like clip members which opposedly face the tongue-like plug portion, the clip members having clutching means capable of fitting the projections thereto in a rebound manner. Otherwise, the male fastening means comprises a flat bit-form, captive pin member whereas the female fastening means comprises detent members capable of fitting the pin member thereto in a rebound manner. Further, the male fastening means comprises wedge-form captive projections on both faces, and the female fastening means is formed with captive openings capable of snapping the projections therein. When the male and female fastening means are locked and interconnected or unlocked and disconnected, the necktie can be worn or released quickly.

7 Claims, 8 Drawing Sheets

QUICK-RELEASE NECKTIE

BACKGROUND OF THE INVENTION

1. Field of the Invention

This invention relates to a quick-release necktie comprising a preliminarily tied necktie base including front and rear aprons or wings and a knot, and neckbands extending on both left and right sides of the knot, wherein male and female fastening means are releasably secured to the ends of the neckbands to link them so that the necktie can be readily worn or released only by simple connecting or disconnecting operation of the fastening assembly, whereby the necktie can be worn around the neck portion of a shirt or the like without any action of tieing to form a knot.

2. Related Art Statement

Quick-release necktie or ready-for-wear necktie is a preliminarily tied necktie forming a knot and assumes a similar appearance to normally tied necktie upon wearing. Such quick-release neckties are very convenient and handy for businessmen, white-color workers, etc., since they can be worn instantly under the collar of a shirt or the like by one hand operation. In particular, where such neckties are adopted as neckties for uniforms, the size of the knot and length of the front apron are normalized and unified, and consequently, such uniform neckties when worn can make an impression of unified beauty to look at. That being so, vast increase in demand of them may be expected henceforth.

Typical of an existing quick-release necktie of the foregoing kind is that as illustrated in the accompanying FIG. 10. According to it, a necktie of a four-in-hand type comprises a necktie base (1) including an inverse triangular knot (2) and aprons (3) consisting of front apron and rear apron suspended downwardly of the knot (2), neckbands (4) (4') extending on both right and left sides of the knot (2), which neckbands are to be passed between the collar and neck portion of a shirt or the like in a wrapping manner, and a pair of detachable fitting means of hook and eye (5)(5') attached at top ends of the neckbands (4)(4'). The reference numeral (6) is an adjustor for adjusting the practical length of the neckband (4).

In wearing this conventional quick-release necktie, the neckbands (4)(4') are first wrapped around the neck portion of a shirt under its collar and then linked together by catching the one hook portion (5) in the other ring portion ( 5'), thus permitting to finish to wear the necktie instantly.

However, the foregoing known quick-release necktie has been found to be badly dangerous in that where a tension force is applied to the apron portion (3) by violence force or a traction force of abnormal strength is acted upon it owing to an unforeseeable accident such as involvement into a machine, immediate disconnection in the longitudinal direction of the neckbands (4)(4') cannot be performed surely, so that wearer's neck may be tighten firmly.

When the necktie is worn in a loose fashion in the state that the neckbands (4)(4') are elongated longer than the size around the neck portion of a shirt, there is a significant tendency for the detachable fitting means (5) (5') toward detaching abruptly. This has made unable to adopt such quick-release type of necktie for women's necktie fashion in a loose-tied sense, and consequently, has obstructed extending the necktie market for women's clothing field.

This invention has been accomplished to work on the problems and defects known quick-release neckties like that have had.

SUMMARY OF THE INVENTION

A primary object of this invention is to provide an improved quick-releasable fastening assembly for a quick-release necktie which assembly can interconnect neckbands and comprises male plug fastening means and female socket means, both being shaped in a small-sized and flat form resembling the cross-sectional form of the neckbands thereby to enhance the appearance of connecting zone of the necktie.

Another object of this invention is to permit, on the one hand, wearing of a necktie merely by quickly fitting both male and female fastening means to one another in a manner of rebound and spring and, on the other hands, removement of it by quick release of the fastening assembly only by one hand operation without necessity of troublesome operation such as buttoning operation, thus making more handy.

A further object of this invention is to provide a quick-releasable fastening assembly for a necktie which, in normal use state, maintains engagement of a constant force, but can be surely disengaged in case where an extraordinarily large tension force is applied to the necktie base, thereby to improve security or safety of the necktie.

This invention for achieving the aforesaid objects will be summarized below.

One aspect of this invention resides in a quick-release necktie comprising a preliminarily tied necktie base having a knot, neckbands extending on both right and left sides of the knot which are to be wrapped around the neck portion of a shirt or the like under its collar, and a pair of male and female quick-releasable fastening means attached to the extending ends of the neckbands, wherein the male fastening means is formed integrally of a flat grip portion linked to the end of the one neckband and a tongue-like plug portion at its top, the plug portion having, on both faces thereof, wedge-form, captively engaging projections; the female fastening means is formed integrally of a base end portion linked to the end of the other neckband and, at its top, a pair of juxtaposed plate-like clip members facing vis-a-vis the tongue-like plug portion of the male fastening means, the plate-like clip members being provided with clutch members capable of fitting and retaining the captive projections thereto in a rebound manner in the corresponding areas matching the captive projections.

Another aspect of this invention consists in a quick-releasable necktie comprising a preliminarily tied necktie base forming a knot, neckbands extending on both right and left sides of the knot which neckbands are to be wrapped around the neck portion under a collar of a shirt or the like, and a pair of male and female quick-releasable fastening means attached to the ends of the neckbands, wherein the male fastening means is integrally formed of a flat grip portion linked to the end of the one neckband and a flat bit-like captive engaging pin member at its top; the female fastening means is formed of a pair of upper and lower plate-like clip members having rebound and spring properties linked to the end of the other neckband, the clip members being provided integrally, on top thereof, with click (or detent) members in the opposite positions which members are capable of fitting and retaining the engaging pin member thereto in a rebound manner.

A further aspect of this invention is in a quick-release necktie comprising a preliminarily tied necktie base having a knot, neckbands extending on both right and left sides of the knot, which are to be wrapped around the neck portion of a shirt or the like, and a pair of male and female quick-releasable fastening means attached to the end of the neckbands, wherein the male fastening means is integrally formed of a flat grip portion linked to the end of the one neckband and a tongue-like plug portion at its top, the plug portion having, on both faces, wedge-form, captive engaging projections; the female fastening means is integrally formed of a base end portion linked to the end of the other neckband and a pair of juxtaposed plate-like clip members at its top which members face vis-a-vis the tongue-like plug portion of the male fastening means, the plate-like clip members being apertured at right angles to the inserting direction of the tongue-like plug portion, in the corresponding areas matching the captive engaging projections, with captive engaging holes capable of snapping the captive engaging projections therein.

According to the quick-release necktie of this invention thus constructed, wearing of it can be finished quickly since when its neckbands are wrapped around and put on the neck portion under a collar of a shirt or the like, it is only necessary to snap both fastening means attached to the ends of the neckbands into engagement with each other. At this time, the male fastening means and female fastening means fit in engagement with each other in a rebound manner between the captive projections of the former and the clutching socket portions of the latter, and the neckbands are connected together by a required strength of connection. As a consequence, not only does the necktie not release readily in normal use, avoiding unexpected disconnection, but also even if a large tension force acts on the necktie base, the engagement between the male and female fastening means is automatically released, thus preventing from tightening wearer's neck.

On the other hand, in removing the necktie, the one of fastening means is slanted relatively to the other. This causes the male fastening means to push open the plate-like clip members of the female fastening means by reason of the principles of the level and fulcrum, and as a result, the engaging projections move out of engagement with the clutching socket portions. Accordingly, the necktie can be removed readily only by one hand operation.

BRIEF DESCRIPTION OF THE DRAWINGS

The invention will be described hereinbelow in more detail with reference to the accompanying drawings in respect of preferred embodiments.

DETAILED DESCRIPTION OF THE PREFERRED EMBODIMENTS

Figure 1:
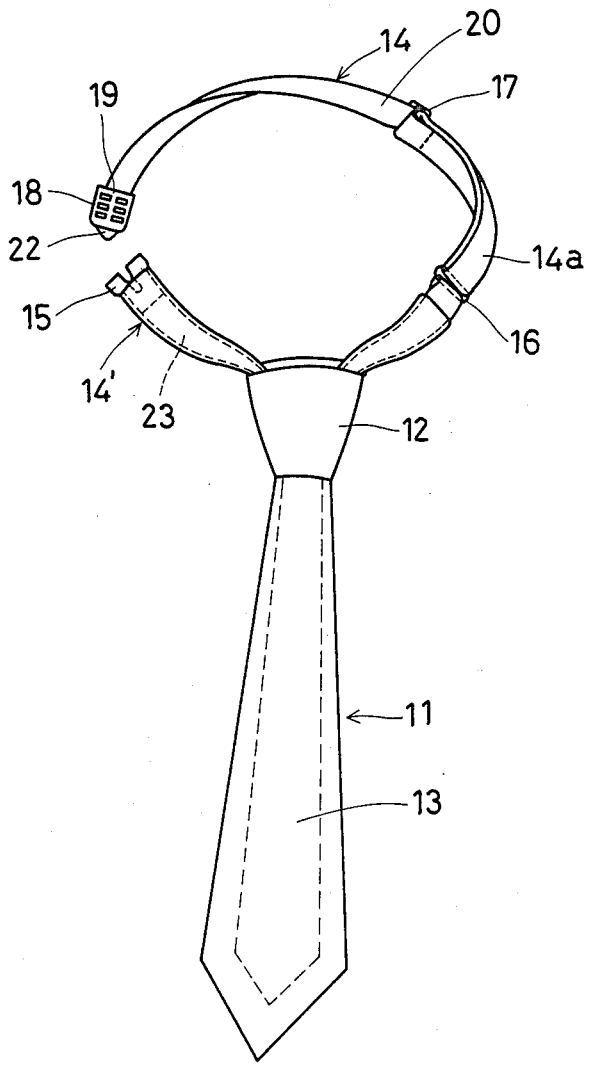
FIG. 1 is an illustration showing the entirety of a quick-release necktie according to this invention.
Figure 2:
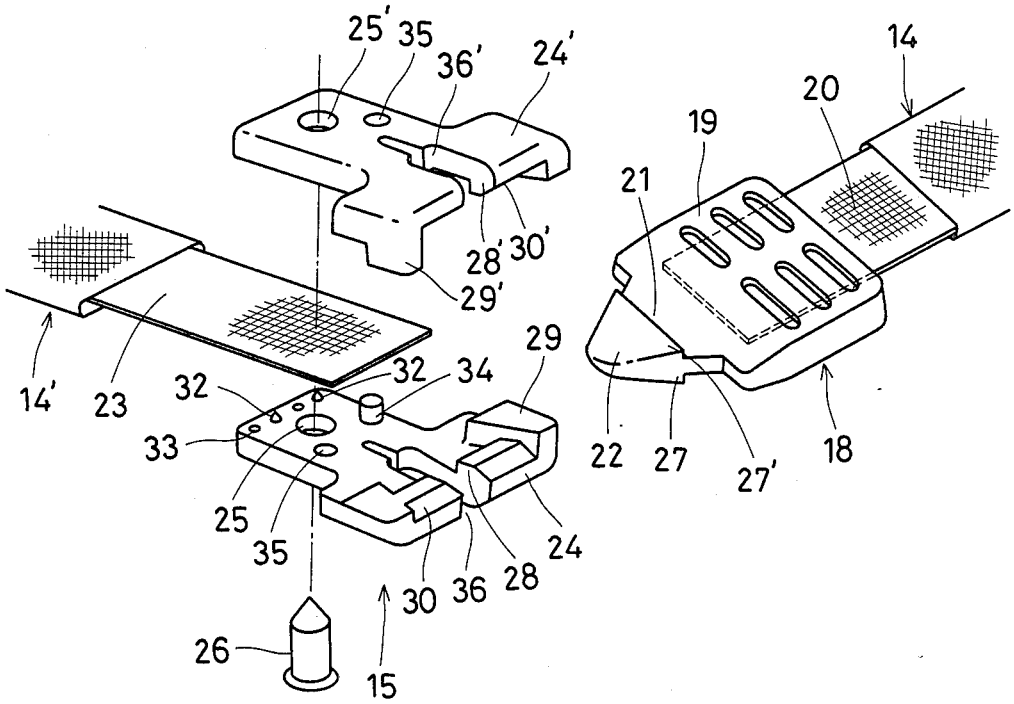
FIG. 2 is an exploded perspective view showing one example of a fastening assembly for use in the necktie shown in FIG. 1.

Now, an example of FIGS. 1 to 3 will be described. The reference numeral 11 designates a necktie base preliminarily tied comprising a knot 12, and necktie aprons including a front apron and a rear apron. The reference numerals 14, 14' are neckbands extending on both right and left sides of the knot 12, and the one neckband 14' such a length that its end may be hidden when put on under the collar of a shirt or the like and is attached, at the end, with female quick-releasable fastening means 15 constituting an essential part of this invention, whereas the other neckband 14 is formed, in its middle area, with a length adjusting portion **14*a* extending between a laterally elongated ring 16 and an adjustor 17 so that the neckband portion 14*a* passes through the ring 16, is folded back there and is inserted into the adjustor 17, whereby length of the neckband 14 can be adjusted by the movement of the adjustor 17**.

At the end of the neckband 13, there is attached male quick-releasable fastening means 18, which is formed integrally of a flat grip portion 19 on the base end side, a flat tongue-like plug portion 21 protruding in front of the grip portion 19, and a flat bit-form engaging pin member 22 forming an end of the portion 21. The grip portion 19 is linked securely to the end of a cloth tape 20 constituting a padding for the neckband 14 by mold fabrication so that the cloth tape may be embedded in the grip portion. The upper and lower faces of the tongue-like plug portion 21 are formed with wedge-form captive projections 27, 27' to constitute a flat bit-form engaging pin member 22 in front of the plug portion 21.

On the other hand, the female fastening means 15 is constructed by joining a pair of upper and lower clip members 24, 24' in opposing manner, which members are fabricated in mutually symmetrical shapes relative to the outside and inside of a cloth tape 23 as a padding for the neckband 14', namely, fabricated with the aid of the same mold. These members 24, 24' are joined together through a rivet 26 entered in through-holes 25, 25' by caulking processing and secured to one end of the cloth tape 23 in an embedding manner.

The clip members 24, 24' are provided, at their mutually facing tops, with click (detent) members 28, 28' capable of snapping into engagement with the captive projections 27, 27' of the male fastening means 18. The click members 28, 28' are provided each, on one side, with side walls 29, 29' capable of impeding the lateral movement of the captive pin member 22 of the male fastening means 18 in the engagement state. The side walls 29, 29' conjointly form internally a socket opening 31 in a level rectangular form having, at the top end of the female fastening means 15, sloping guide faces 30, 30' which confront to one another in the state that the detent members 28, 28' confront one another.

On the confronting faces of the clip members 24, 24' to be joined, there are formed conical convex members 32 for preventing disjoining and inverse conical recesses 33 for receiving the conical convex members 32 therein; and projections 34 for preventing swivel movement and holes 35 for receiving the projections 34 therein to prevent swivel movement. The reference numerals 36, 36' designate slits defined in the front ends of the clip members 24, 24' to increase elastic force of them.

The female fastening means 15 and the male fastening means are usually made of a synthetic plastic material having good mechanical properties, e.g. tensile strength, flexural strength, impact strength, wear resistance, etc. as well as appropriate bending elasticity, such as acetal resins, i.e. polymers or copolymers of formaldehyde (trade mane: e.g. Duracon, Delrin).

Now, operation and fuction of the quick-release necktie of this invention having the construction described above will be explained.

Figure 3A:
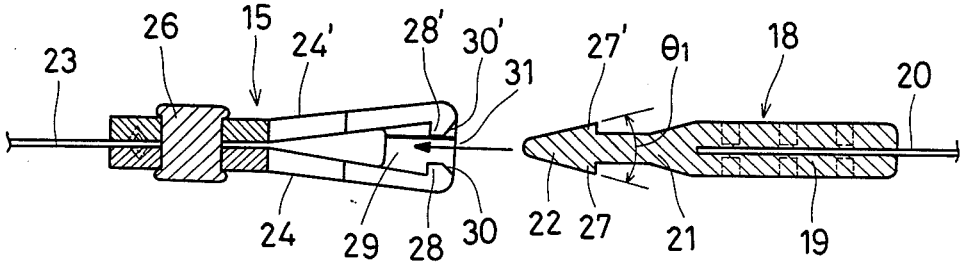
FIG. 3 is a side cross-sectional view showing the fastening assembly shown in FIG. 2, and (a) illustrates a state before fitting, (b) a state of fitting into engagement, and (c) a state of disengagement for release.
Figure 3B:
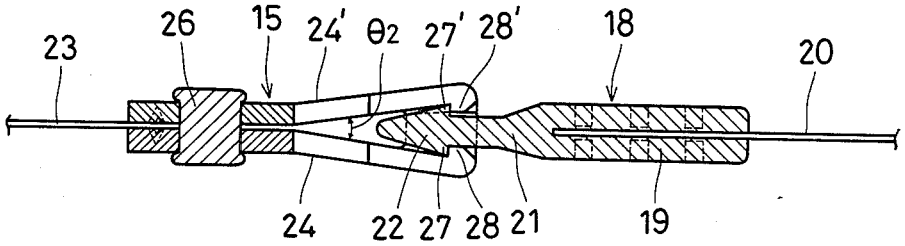
Figure 3C:
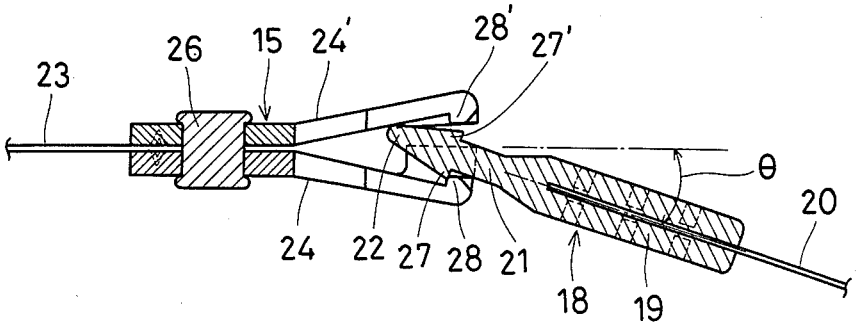

In wearing the quick-release necktie, the neckbands 14, 14' are wrapped around and put on the neck portion of a shirt or the like under its collar and the quick-releasable fastening means 15, 18 at the ends of the neckbands 14, 14' are locked together as shown in FIG. 3(*b*). At this time, the female fastening means 15 is locked to the male fastening means 18 by the engagement of the detent members 28, 28' with the captive projections 27, 27' in a rebound manner. Consequently, disengagement of the male fastening means 18 in its pulling direction is prevented owing to a required strength, which state is maintained under usual use conditions without release. Once an unexpected, large tension force acts upon the apron portion 11, the male fastening means 18 unlocks from the female fastening means 15, thereby to avoid the danger of the wearer's neck being tightened.

Under engagement connection conditions, a tip angle $\theta_1$ of the captive engaging pin member 22 of the male fastening means 18 and an inner open angle $\theta_2$ of the socket portion of the female fastening means 15 are in relation of:

$$\theta_1 > \theta_{2(min)}$$

and there exists a play angle of $\theta_1 - \theta_{2(min)}$ between both.

Hence, where the necktie is worn in a loose state, there is no danger that both fastening means 15, 18 unlock unexpectedly and abruptly, and interconnection of the neckbands 14, 14' can be maintained. In this case, too, even if the relation of $\theta_2 = \theta_1$ exists, similar connection state can be achieved.

The tip angle $\theta_1$ of the engaging pin member 22 is preferred to be not so large, taking account of the engagement force with the female fastening means 15, and usually is in the neighborhood of 30° from the practical viewpoint.

When both fastening means 15, 18 are unlocked, the relative inclination angle $\theta$ is increased gradually while both are pulled in the disconnecting directions. The moment that $$\theta > \frac{\theta_{2(max)} - \theta_1}{2}$$

is reached, the engaging pin member 22 of the male fastening means 18 move rotatably around a fulcrum of the one detent member 28 to push open the clip members 24, 24' at their tops and eventually, the engagement between the captive projection 27' of the engaging pin member 22 and the detent member 28' is released, whereby both fastening means 15, 18 can be readily disconnected. As a consequence, it is possible to relesase and remove the necktie readily and instantly only by holding and pulling the grip portion 19 of the male fastening means 18 in one hand while slanting it relative to the female fastening means 15 in either direction of the clip members.

The foregoing example as shown is an embodiment wherein the fastening means 15, 18 are attached by embedding padding cloth tapes 20, 23 of the neckbands 14, 14', respectively therein as a means for attachment of both fastening means 15, 18 to the respective ends of the neckbands 14, 14'. As the attachment means, for instance, it is also possible to link beforehand cloth tapes each of 5–8 cm in length to the fasening means 15, 18, to insert their free ends into sheel-like (flat cylinder-shaped) neckbands and to sew the tapes and neckbands together.

Figure 4:
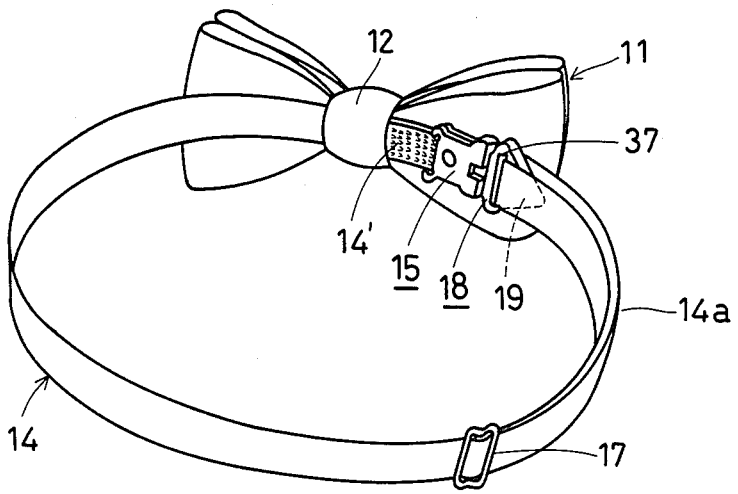
FIG. 4 is a perspective view showing another example of a quick-release necktie of this invention.
Figure 5:
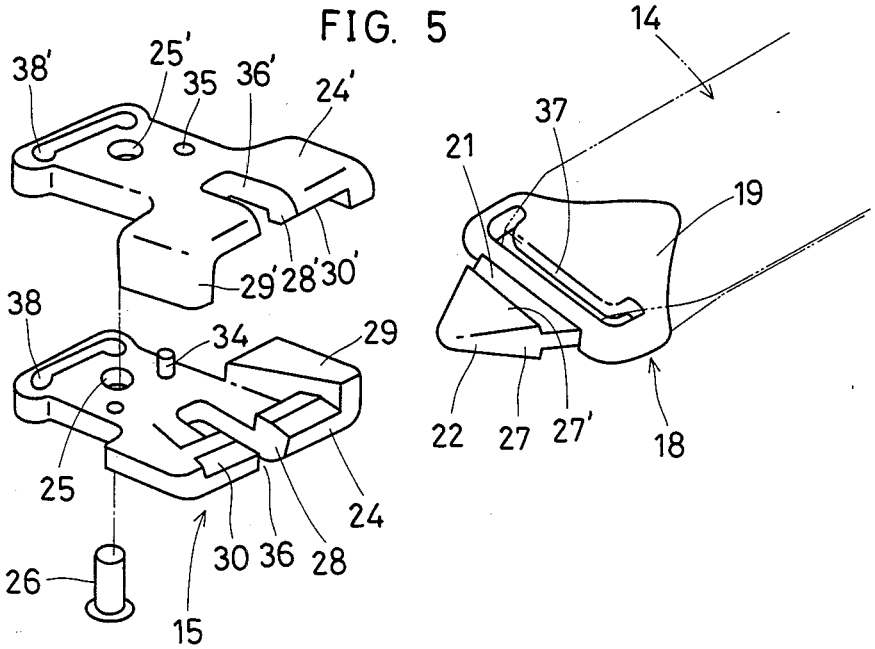
FIG. 5 is an exploded perspective view showing another example of a fastening assembly for use in the necktie shown in FIG. 4.

FIGS. 4 and 5 show another example of a quick-release necktie pertaining to this invention. FIG. 4 is a perspective view of a bow tie as viewed from behind and FIG. 5 is an exploded perspective view of the fastening assembly applicable to the bow tie shown in FIG. 4.

The necktie base 22 comprises right and left wings 13 and the knot 12 in the center. On the rear side of the knot 12, the one neckband 14 made of a cloth tape and the other neckband 14' made of rubber string extend on the left and right sides of it. The neckband 14 of the cloth tape is, at its top end, passed through a laterally elongated slot 37 apertured at the grip portion 19 of the male fastening means 18 and turned back longitudinally, and the turnup end is linked to the adjustor 17 and sewn with the adjusting portion 14*a* whereby the neckband 14 is linked to the male fastening means 18, lapping the grip portion 19 therein. The neckband 14' of rubber string is passed through a laterally elongated slots 38, 38' apertured at the base end portion of the clip members 24, 24', in a loop form, with its lapped end sewn into the knot 12. The elongated slots 37, 38, 38' bored at the grip portion 19 of the male fastening means 18 and at the base end portion of the female fastening means 15 are each formed, at both ends, in a L-bend form along connecting and disconnecting directions so as to allow the neckbands 14, 14' having substantially the same breadth as or broader than both fastening means 15, 18 to be passed therethrough. In FIGS. 4–5, like reference numberals designate like members or portions.

In wearing the quick-release necktie thus constructed, after adjusting the length of the neckband 14 of cloth tape with the aid of the adjustor 17, the neckband 14 is wrapped around the neck portion of a shirt or the like, the grip portion 19 of the male fastening means 18 is held together with the neckband 14 covering it in one hand while the female fastening means 15 is held in the other hand, and then, both are fitted in one another in socket-plug fashion. In this way, the necktie can be readily worn at the collar.

The necktie thus worn can fit well the neck portion of a shirt owing to the stretch force of the neckband 14' of rubber string, and moreover, since the male and female fastening means 15, 18 are fitted in socket-plug fashion in a rebound manner, there is no danger of unexpected, abrupt release of necktie during wearing.

In removing the necktie, it can be readily released, as in the case with FIG. 3(*c*), merely by slanting largely the male fastening means 15 relative to the female fastening means 18 in one hand.

Figure 6:
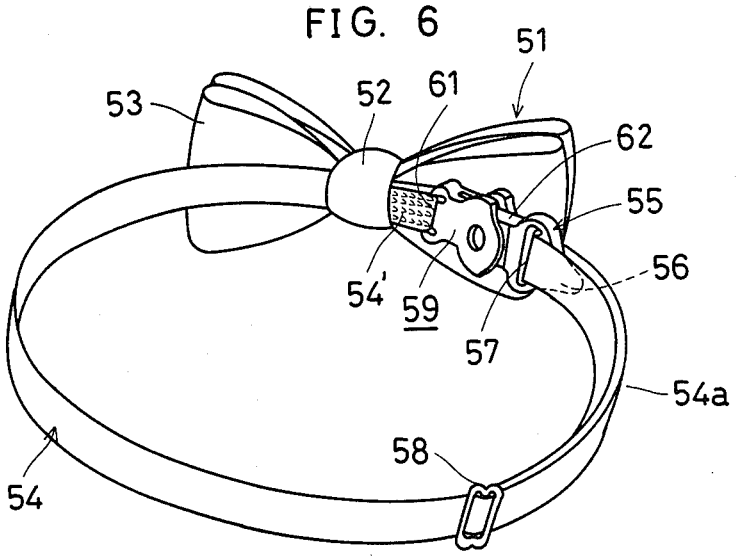
FIG. 6 is a whole perspective view showing a further example of a quick-release necktie of this invention.
Figure 7:
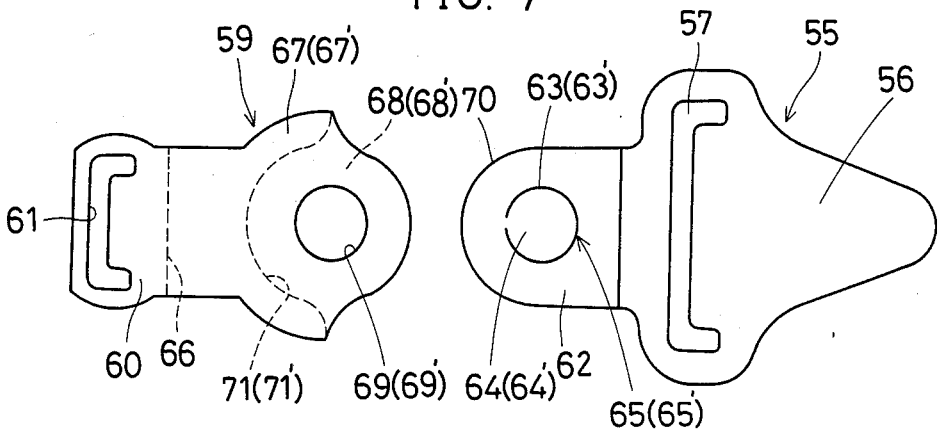
FIG. 7 is a plan view showing a further example of a fastening assembly for use in the necktie shown in FIG. 6.
Figure 8A:
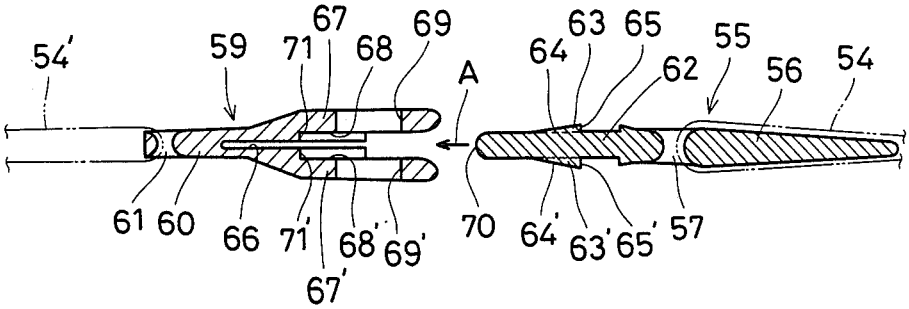
FIG. 8 is a longitudinal cross-sectional view showing the fastening assembly shown in FIG. 7, and (a) illustrates a state before fitting, (b) a state upon fitting and engagement, and (c) a state of disengagement for release.
Figure 8B:
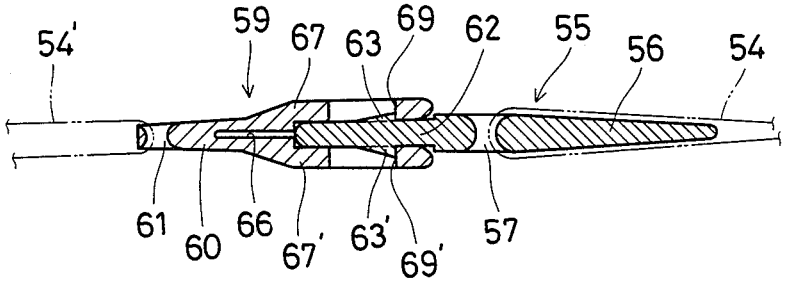
Figure 8C:
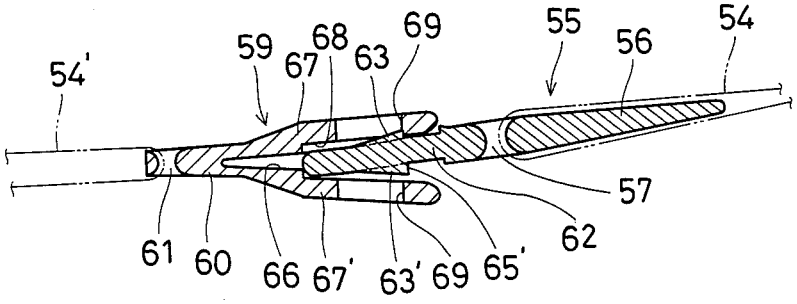

FIG. 6 to FIG. 8 shows a further example of a quick-release necktie with which this invention is concerned. In these figures, the reference numeral 51 designates a bowtie base comprising a preliminarily tied knot 52 and wings 53 extending on both sides of the knot 52. In the necktie base 51, a neckband 54 of a cloth tape and a neckband 54' of stretchable tape such as rubber string are attached to the knot 52 from behind, extending on both right and left sides of the knot 52.

The neckband 54 of cloth tape is, at its top end, passed through a laterally elongated slot 57 in a tapered tongue-like grip portion 56 formed at the rear portion of the male fastening means 55 and turned back longitudinally with its turnup end sewn into an adjustor portion 54*a* near an adjustor 58, whereby the neckband 54 is linked to the male fastening means 55 in the state of lapping the grip portion 56 therein so as to be adjustable in length.

The neckband 54' of rubber string is passed through a laterally elongated slot 61 of the female fastening means 59 apertured at the base end portion 60 thereof in a loop form, with both lapped ends inserted and sewn into the knot 52, thereby to captively secure the female fastening means 59 to the necktie base 51.

The male fastening means 55 is formed integrally of the grip portion 56 and, on the front end side of the grip portion 56, a tonguie-like plug portion 62 slightly thinner than the maximum thickness of the grip portion 56, which is, on both central faces thereof, formed integrally with captive projections 63, 63' of a wedge-form profile assuming a circle in the vertically projected plane, namely of an elliptical wedge-form as viewed from a perspective location.

The captive projections 63, 63' have wedge-like slope faces 64, 64' which are inclined gently tapering down toward the inserting direction (arrow direction A in FIG. 8(*a*)) of the tongue-like plug portion 62, thus forming captive engaging offsets 65, 65' of cylindrical profile between the rear ends of the wedge-form slope faces 64, 64' and both faces of the plug portion 62.

On the other hand, the female fastening means 59 is integrally formed of the base end portion 60 and a pair of juxtaposed plate-like clip members 67, 67' extending in front of the base end portion 60 which members are divided into two in the thickness direction by a slit 66. On the confronting faces of both plate-like clip members 67, 67', pinching offset portions 68, 68' of such a size that permits to insert the tongue-like plug portion 62 of the male fastening means 55 into them are formed, and circular captive holes 69, 69' capable of receiving therein the wedge-form captive projections 63, 63' of the male fastening means 55 are defined through the centers of the plate-like clip members 67, 67'.

The front top face 70 of the tongue-like plug portion 62 of the male fastening means 55 and cylindrical offset faces 71, 71' of the pinching offset portions 68, 68' of the female fastening means 59 constitute a concentricity, respectively, with the captive projections 63, 63' and with the captive holes 69, 69', and are adapted to relatively move rotatably at a required angle in the state that the male fastening means 59 and female fastening means 55 are fitted to one another.

Laterally elongated slots 57, 61 apertured at both fastening means 55, 59 for linking to the neckbands 54, 54' therethrough are usually fabricated so that their both ends may bend in hook forms, and sizes of the slots 57, 61 may be determined so that neckbands 54, 54' as broad as or broader than both fastening means 55, 59 may be passed through them.

When the quick-release necktie thus constructed is worn, first, the neckband 54 is wrapped around the neck portion of a shirt or the like under its collar; and the tip of the tongue-like plug portion 62 of the male fastening means 55 is plugged in between the plate-like clip members 67, 67' of the male fastening means 59 thereby snapping both means into engagement as shown in FIG. 8(*b*). At this time, the female fastening means 59 captively holds the male fastening means 55 at a required strength, since the plate-like clip members 67, 67' are urged toward the restoration directions of the fastening assembly, namely approaching directions because of the elastic force in their portions joined to the base end portion 60 and the captive projections 63, 63' of the male fastening means 55 are fitted and held in the captive holes 69, 69' of the clip members 67, 67' of the female fastening means 59. As a consequence, in normal use condition, the fastening assembly cannot release readily and there is no danger of unexpected release of the necktie.

Moreover, the male and female fastening means 55, 59 can move relatively in swivel manner centering on the captive projections 63, 63' and the captive holes 69, 69', and consequently, angle adjustment is possible and it is possible to snugly fit the neck portion of a shirt by expansion and contraction actions of the neckband 14' of rubber string. Also when the necktie is worn in a loose fashion by adjusting the neckband 54 of cloth tape a little longer, the fastening assembly 55, 59 maintains its fitting engagement at a required strength and accordingly, there is no inconvenience of the necktie being released abruptly.

In disconnecting the fastening assembly 55, 59 as shown in FIG. 8(*c*), when both fastening means are slanted at a large angle while pulling them in the disconnecting directions, the tongue-like plug portion 62 of the male fastening means 55 is inclined within the pinching offset portions 68, 68' in the thickness direction to push open the plate-like clip members 67, 67' against the elastic force of the base end portion 60, and the captive projection 63 or 63' moves clear of the captive hole 69 or 69', whereby both fastening means 55, 59 can be readily unlocked. Consequently, it is possible to remove the necktie readily and quickly merely by holding the grip portion 56 of the male fastening means 55 together with the neckband 54 covering it and pulling the grip portion while slanting it in the thickness direction. Likewise, it is also possible to disconnect the fastening assembly by moving rotatably sideways the grip portion 56 of the male fastening means 55 against the female fastening means 59, centering the captive projections 63, 63' and the captive holes 69, 69', to a great degree.

Connection strength between the male fastening means 55 and the female fastening means 59 is determined depending on elastic force of joining part of the plate-like clip members 67, 67' of the female fastening means 59; engagement area between the captive offset portons 65, 65' at the rear ends of the captive projections 63, 63' and the inner faces of the captive holes 69, 69'; and rising angle of the captive offset portions 65, 65' at the rear ends of the captive projections 63, 63', in combination. Accordingly, it is possible to set optionally the connection strength of both means only by varying the aforesaid factors.

The foregoing example is concerned with an embodiment in which the captive projections 63, 63' and the captive holes 69, 69' assume flat circular shapes, but shapes of them may be an elliptical or polygonal form or other appropriate form.

Figure 9:
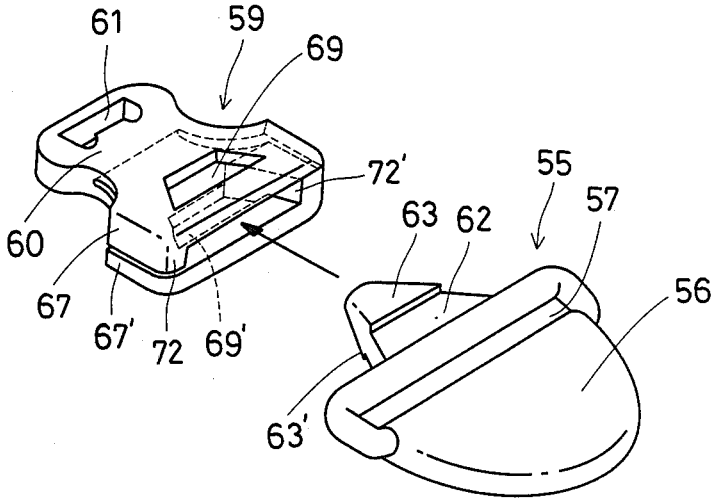
FIG. 9 is an exploded perspective view showing a still further example of a modified fastening assembly for use in a quick-release necktie of this invention.
Figure 10:
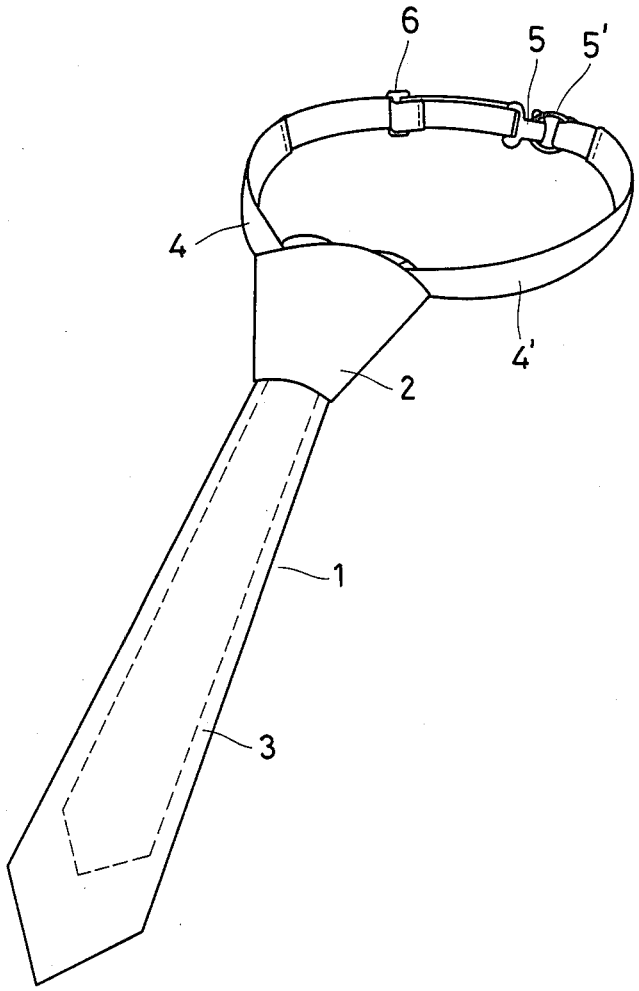
FIG. 10 PRIOR ART
FIG. 10 is a representative illustration showing a prior art quick-release type of necktie.

FIG. 9 shows a still further example of a quick-release necktie pursuant to this invention, wherein the plate-like clip members 67, 67' of the female fastening means 59 are, on their central parts, apertured with trapezoidal captive holes 69, 69' which are capable of fitting engagingly therein triangular wedge-form captive projections 63, 63' formed on both surfaces of the tongue-like plug portion 62 of the male fastening means 55 in a protruding fashion. The front end of the female fastening means 59 is, on the lateral sides of openings for inserting, formed integrally with side walls 72, 72' which serve to abut on the tongue-like plug portion 62 of the male fastening means 55 to avoid it from escaping sideways thereby to facilitate the inserting operation.

In FIG. 9, like reference numerals designate like members and like portions as in FIGS. 6 to 8.

In the quick-release necktie thus constructed, the tongue-like plug portion 62 of the male fastening means 55 is inserted into the socket opening at the front end of the female fastening means 59 to snap the captive projections 63, 63' in the captive holes 69, 69' in rebound, spring manner, whereby both fastening means 55, 59 are interconnected, linking the neckbands 54, 54'.

When the fastening assembly 55, 59 thus connected are disconnected, the male fastening means 55 is slanted largely to the female fastening means 59 as is the case with the above examples, and released quickly.

The necktie of this invention is applicable not only to orthodox four-in-hand neckties and bow ties, but to decorative ribbon ties having a similar construction to bow ties and suited for women and girls.

As described above in detail, the quick-release necktie of this invention can be worn readily and quickly since it is only required to pass and wrap the neckbands extending on both right and left sides of the knot of the preliminarily tied necktie base around the neck portion of a shirt or the like, and to bring the male and female fastening means attached to the neckbands into fitting engagement. After wearing, the neckbands are linked together with both fastening means fitted and engaged to one another by a required strength, so that abrupt or unexpected release doesn't occur in normal use. Moreover, in case where extraordinarily large tension force is applied to the apron portion of the necktie, the fastening assembly is automatically unlocked thereby to prevent wearer's neck from being tightened. When the necktie is removed, the fastening assembly can be unlocked instantly only by slanting them mutually. Thus, the quick-release necktie is offered which is excellent in respect of easiness of fitting-release operation, durability, and safety or security.

It is further possible to wear the necktie of this invention in a loose fit manner by easy fitting-release operation because no fastening assembly is released abruptly. This permits to develop uses for women's necktie fashion and greatly assits in enlargement of market on women's clothing field.

The embodiments of the invention in which an exclusive property or privilege is claimed are defined as follows:

1. A quick-release necktie comprising a necktie base of a preliminarily tied necktie having a knot and neckbands extending on left and right sides of the knot which are to be wrapped around the neck portion of a shirt or the like under its collar, wherein said neckbands are, at their extending ends, attached to a pair of male and female quick-releasable fastening means;

said male fastening means being integrally formed of a flat grip portion linked to an end of a one of said neckbands and a tongue-like plug portion at a free end of said flat grip portion, said tongue-like plug portion being provided with wedge-form captively engaging projections; and said female fastening means being integrally formed of a base end portion linked to an end of an other of said neckbands and a socket portion including a pair of juxtaposed plate-like clip members which opposedly face said tongue-like plug portion, said plate-like clip members being provided with clutching means, in their corresponding facing areas, matching said projections, said clutching means being capable of elastic yielding movement away from each other and toward each other to become clampingly engaging with said projections and a releasable locking of said projections to said female fastening means, said tongue-like plug having oppositely facing inclined surfaces forming an angle $\theta_1$ opening in a direction facing away from said female fastening means, said pair of plate-like clip members normally forming an angle $\theta_{2(min)}$ therebetween to effectively block withdrawal of said projections out of engagement with said clutch means, said pair of plate-like clip members being elastically yieldably separated to form an angle $\theta_{2(max)}$ in response to a sufficient force desirously for separating said pair of plate-like clip members toward said angle $\theta_{2(max)}$ to facilitate a free and unobstructed separation of said male and female fasteners and a release from the coupling engagement with one another, said release occurring when a relation of $$\theta > \frac{\theta_{2(max)} - \theta_1}{2}$$

wherein $\theta$ is an angle formed between said male and female fastening means, said angle $\theta$ being measured from an angle bisector of said angle $\theta_2$, whereby said male and female fastening means are locked and interconnected or unlocked and disconnected to wear or release the necktie.

2. A quick-release necktie as claimed in claim 1, wherein said male and female fastening means are each made of a synthetic plastic having both good mechanical properties and resilience.

3. A quick-release necktie as claimed in claim 2, wherein said synthetic plastic is an acetal resin.

4. A quick-release necktie as claimed in claim 1, wherein said preliminarily tied necktie is selected from a four-in-hand necktie, a bow tie, and a decorative ribbon tie.

5. A quick-release necktie comprising a necktie base of a preliminarily tied necktie having a knot and neckbands extending on left and right sides of said knot which are to be wrapped around the neck portion of a shirt or the like under its collar, wherein said neckbands are attached, at their extending ends, with a pair of male and female quick-releasable fastening means;

said male fastening means being integrally formed of a flat grip portion linked to an end of a one of said neckbands and a flat bit-form, captively engaging pin member projecting outwardly from both sides thereof at a free end thereof; and said female fastening means being formed integrally of a pair of upper and lower plate-like clip members linked to an end of an other of said neckbands, said clip members being capable of elastic yielding movement away from each other and toward each other, said clip members each being provided, at their free ends, with detent members capable of fitting into engagement with said pin member to hold said pin member in place, said pin member projecting from both sides of said flat grip portion, each said pin member having oppositely facing inclined surfaces forming an angle opening in a direction facing away from said female fastening means, said pair of plate-like clip members normally forming a minimum angle therebetween to effectively block withdrawal of said pin members out of engagement with said detent members, said pair of plate-like clip members being elastically yieldably separated to form a maximum angle in response to a sufficient force desirously for separating said pair of plate-like clip members toward said maximum angle to facilitate a free and unobstructed separation of said male and female fasteners and a release from the coupling engagement with one another, whereby said male and female fastening means are locked and interconnected or unlocked and disconnected, thus wearing or releasing the necktie.

6. A quick-release necktie comprising a necktie base of a preliminarily tied necktie having a knot and neckbands extending on both left and right sides of said knot which are to be wrapped around the neck portion of a shirt or the like under its collar, wherein said neckbands are attached, at their extending ends, with a pair of quick-releasable male and female fastening means;

said male fastening means being integrally formed of a grip portion linked to an end of a one of said neckbands and a tongue-like plug portion at a free end thereof, said plug portion being provided, on both faces thereof, with wedge-form captively engaging projections; and said female fastening means being integrally formed of a base end portion linked to an end of an other of said neckbands and a pair of juxtaposed plate-like clip members at a free end thereof, which members face vis-a-vis said tongue-like plug portion of said male fastening means, said plate-form clip members being apertured, at right angles to an inserting direction of said plug portion, with captively engaging openings which are capable of snapping said projections into engagement with them in their corresponding facing areas which match said projections, said tongue-like plug having oppositely facing inclined surfaces forming an angle opening in a direction facing away from said female fastening means, said pair of plate-like clip members normally forming a minimum angle therebetween to effectively block withdrawal of said projections out of engagement within said openings, said pair of plate-like clip members being elastically yieldably separated to form a maximum angle in response to a sufficient force desirously for separating said pair of plate-like clip members toward said maximum angle to facilitate a free and unobstructed separation of said male and female fasteners and a release from the coupling engagement with one another whereby said male and female fastening means are locked and interconnected or unlocked and disconnected, thus wearing or releasing the necktie.

7. A quick-release necktie as claimed in claim 6, said projections of said male fastening means have a wedge-form profile assuming a circle in a horizontal projected plane and said openings of said female fastening means are circular-formed.

* * * * *